US006848201B2

(12) United States Patent
Staffaroni et al.

(10) Patent No.: US 6,848,201 B2
(45) Date of Patent: Feb. 1, 2005

(54) SHOCK ABSORPTION SYSTEM FOR A SOLE

(75) Inventors: Michael G. Staffaroni, Dallas, TX (US); Jong Sang Choi, Sasong Ku (KR)

(73) Assignee: Heeling Sports Limited, Carrollton, TX (US)

( * ) Notice: Subject to any disclaimer, the term of this patent is extended or adjusted under 35 U.S.C. 154(b) by 0 days.

(21) Appl. No.: 10/357,776

(22) Filed: Feb. 3, 2003

(65) Prior Publication Data

US 2003/0150133 A1 Aug. 14, 2003

Related U.S. Application Data

(60) Provisional application No. 60/353,877, filed on Feb. 1, 2002.

(51) Int. Cl.[7] ..... A43B 13/20
(52) U.S. Cl. ..... 36/35 B; 36/29
(58) Field of Search ..... 36/35 B, 29, 153

(56) References Cited

U.S. PATENT DOCUMENTS

| | | | | |
|---|---|---|---|---|
| 487,779 A | | 12/1892 | Schoen | |
| 968,020 A | | 8/1910 | Yandoll | |
| 1,502,087 A | | 7/1924 | Bunns | |
| 1,690,696 A | * | 11/1928 | Norwood | 36/35 B |
| 1,888,617 A | | 11/1932 | Bridi | |
| 1,998,624 A | * | 4/1935 | Hughes | 36/35 B |
| 2,466,611 A | | 5/1949 | Nicoletti | 36/36 |
| 2,582,551 A | | 1/1952 | Malherbe | 36/36 |
| 2,632,964 A | | 3/1953 | Kriegel | 36/37 |
| 2,669,038 A | | 2/1954 | De Werth | 36/38 |
| 2,721,400 A | | 10/1955 | Israel | 36/8.5 |
| 3,665,621 A | | 5/1972 | Massella | 36/37 |
| 4,183,156 A | | 1/1980 | Rudy | 36/44 |
| 4,214,384 A | | 7/1980 | Gonzalez R. | 36/42 |
| 4,219,945 A | | 9/1980 | Rudy | 36/29 |
| 4,223,457 A | * | 9/1980 | Borgeas | 36/35 B |
| 4,271,606 A | | 6/1981 | Rudy | 36/29 |
| 4,340,626 A | | 7/1982 | Rudy | 428/35 |
| 4,372,058 A | | 2/1983 | Stubblefield | 36/32 R |
| 4,492,046 A | | 1/1985 | Kosova | 36/27 |
| 4,815,221 A | | 3/1989 | Diaz | 36/27 |
| 4,817,304 A | | 4/1989 | Parker et al. | 36/114 |
| 4,843,737 A | | 7/1989 | Vorderer | 36/38 |
| 4,906,502 A | | 3/1990 | Rudy | 428/69 |
| 4,936,029 A | | 6/1990 | Rudy | 36/29 |
| 5,005,300 A | * | 4/1991 | Diaz et al. | 36/114 |

(List continued on next page.)

FOREIGN PATENT DOCUMENTS

| | | |
|---|---|---|
| IT | 666436 | 8/1964 |

OTHER PUBLICATIONS

Nike AIR Technology Explained, article printed from website located at: http://sneakers.pair.com/airtech.htm, dated Apr. 25, 2003, 2 pgs..

*Primary Examiner*—Ted Kavanaugh
(74) *Attorney, Agent, or Firm*—Hunton & Williams LLP; Robert J. Ward

(57) ABSTRACT

A shock absorption system for a sole of a footwear is provided that includes an inner and outer absorption chamber and a central absorption member. The outer absorption chamber defines a passageway operative to retain a fluid. The outer absorption chamber has an upper side, a lower side and is disposed in a heel portion of the sole of the footwear. The inner absorption chamber defines a passageway operative to retain a fluid. The inner absorption chamber has an upper side, a lower side and is disposed adjacent the outer absorption chamber. The central absorption member is disposed adjacent the inner and outer absorption chambers and extends from an upper side to a lower side of the sole of a footwear through an opening adjacent the inner absorption member.

10 Claims, 2 Drawing Sheets

U.S. PATENT DOCUMENTS

| | | | | | |
|---|---|---|---|---|---|
| 5,042,176 | A | | 8/1991 | Rudy | 36/29 |
| 5,060,401 | A | | 10/1991 | Whatley | 36/25 R |
| 5,083,361 | A | | 1/1992 | Rudy | 29/454 |
| 5,195,257 | A | * | 3/1993 | Holcomb et al. | 36/28 |
| 5,224,278 | A | | 7/1993 | Jeon | 36/29 |
| 4,219,945 | A | | 10/1993 | Rudy | 36/29 |
| 5,282,325 | A | | 2/1994 | Beyl | 36/27 |
| 5,353,459 | A | | 10/1994 | Potter et al. | 12/146 R |
| 5,363,570 | A | * | 11/1994 | Allen et al. | 36/28 |
| 5,373,649 | A | | 12/1994 | Choi | 36/42 |
| 5,381,608 | A | | 1/1995 | Claveria | 36/35 R |
| 5,419,060 | A | | 5/1995 | Choi | 36/36 R |
| 5,502,901 | A | | 4/1996 | Brown | 36/28 |
| 5,519,950 | A | | 5/1996 | Wang | 36/42 |
| 5,544,431 | A | | 8/1996 | Dixon | 36/38 |
| 5,649,374 | A | | 7/1997 | Chou | 36/27 |
| 5,692,322 | A | | 12/1997 | Lombardino | 36/100 |
| 5,704,706 | A | | 1/1998 | Goldston et al. | 362/103 |
| 5,743,028 | A | | 4/1998 | Lombardino | 36/27 |
| 5,930,918 | A | * | 8/1999 | Healy et al. | 36/29 |
| 6,006,449 | A | | 12/1999 | Orlowski et al. | 36/27 |
| 6,013,340 | A | | 1/2000 | Bonk et al. | 428/35.2 |
| 6,055,747 | A | | 5/2000 | Lombardino | 36/37 |
| 6,115,943 | A | | 9/2000 | Gyr | 36/35 R |
| 6,463,612 | B1 | | 10/2002 | Potter | 12/146 B |
| 6,751,891 | B2 | | 6/2004 | Lombardino | 36/28 |

* cited by examiner

FIG. 1
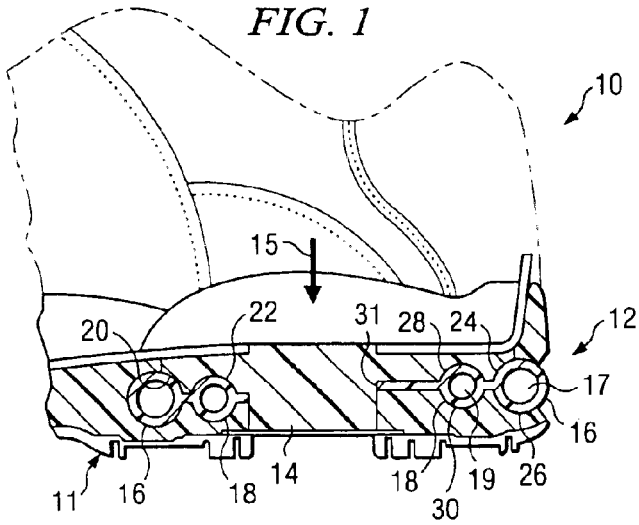
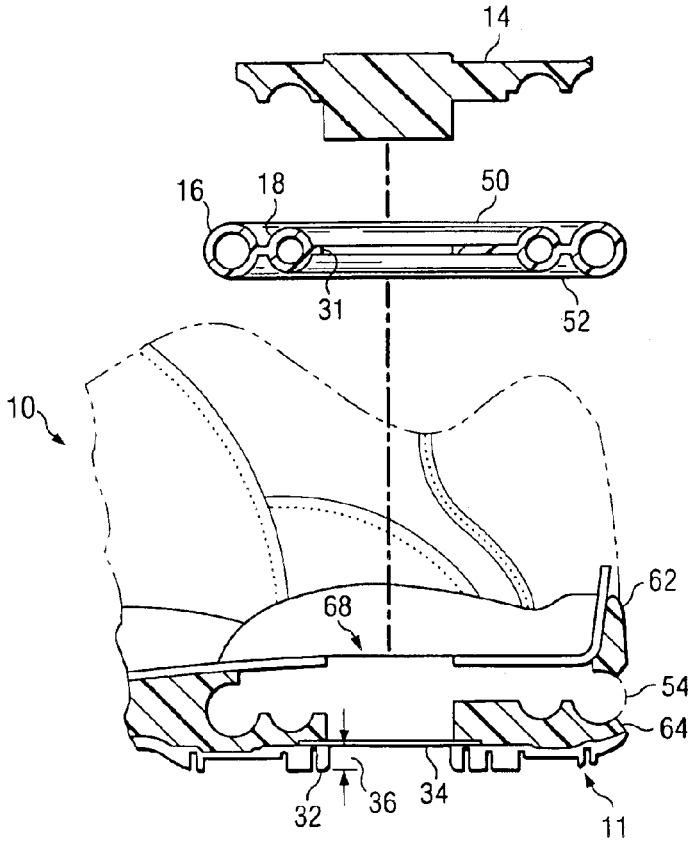
FIG. 2

SHOCK ABSORPTION SYSTEM FOR A SOLE

CROSS-REFERENCE TO RELATED APPLICATIONS

Pursuant to 35 U.S.C. §119(e), this application claims the benefit of U.S. Provisional Patent Application No. 60/353,877, entitled Shock Absorption System For A Sole, filed Feb. 1, 2002, naming Michael G. Staffaroni and Jong Sang Choi as inventors, which is hereby incorporated by reference for all purposes.

TECHNICAL FIELD OF THE INVENTION

This invention relates in general to the field of shock absorption for footwear and more particularly to a shock absorption system for a sole of footwear.

BACKGROUND OF THE INVENTION

Sporting activities place a tremendous strain on the muscles, bones and joints of their participants. Some activities in particular generate more impact and shock to the feet than others. To address the injuries and discomfort associated with the impact of these activities, footwear manufactures have developed thicker soles of differing configurations and constructed from a variety of materials. Also, footwear having a "sticky" characteristic is advantageous during certain activities, such as skateboarding, so that the footwear clings to certain surfaces.

However, a need continues to exist for an improved shock absorption system for the sole of footwear to provide more comfort and further reduce the shock and impact encountered during various physical activities.

SUMMARY OF THE INVENTION

From the foregoing it may be appreciated that a need has arisen for a shock absorption system for the sole of footwear.

According to an aspect of the present invention, a shock absorption system for a sole of a footwear is provided that includes an inner and outer absorption chamber and a central absorption member. The outer absorption chamber defines a passageway operative to retain a fluid. The outer absorption chamber has an upper side, a lower side and is disposed in a heel portion of the sole of the footwear.

The inner absorption chamber defines a passageway operative to retain a fluid. The inner absorption chamber has an upper side, a lower side and is disposed adjacent the outer absorption chamber. The central absorption member is disposed adjacent the inner and outer absorption chambers.

In one aspect, the inner and outer absorption chambers are further defined as substantially U-shaped members. In one aspect, the inner absorption chamber is disposed adjacent and substantially within the U-shape configuration of the outer absorption chamber. The central absorption member is positioned adjacent at least a portion of the upper side of both the inner and outer absorption chambers.

In one aspect, the central absorption member is further defined as having a cylindrical member that extends through an opening defined by the U-shaped configuration of the inner absorption chamber.

In yet another aspect, the inner and outer absorption chambers are further defined as bags operative to retain fluid. In other aspects, the bags are operative to retain a pressurized gas. In yet other aspects, the present invention includes a mat, which may in some aspects be constructed of as polymeric material. The mat is unitarily configured and includes the inner and outer absorption chambers adjacent one another such that the inner absorption chamber is within the U-shaped configuration of the outer absorption chamber.

In one aspect, the central absorption member is positioned substantially underneath a heel impact area of the footwear and extends from a position underneath a heel impact area to substantially an underside of the sole of the footwear. In one aspect, the central absorption member has an inner and outer chamber receiving portion adapted to receive the inner and outer absorption chambers. In one aspect, the inner and outer absorption chambers are disposed adjacent the inner and outer chamber receiving portions of the central absorption member.

In one aspect, the sole of the footwear defines an opening creating an air gap defined at the top by the central absorption member and on the sides by the opening in the lower portion of the sole. One advantage of the present aspect is that the air gap creates a suction that provides the present invention with an improved sticky characteristic.

Other objects, features, and advantages of the present invention will be apparent to those skilled in the art from the following detailed description when read in conjunction with the accompanying drawings and appended claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 1 is a cross-section of a footwear illustrating a shock absorption system for a sole of a footwear in accordance with one aspect of the present invention;

FIG. 2 is a side view, according to one aspect of the present invention, illustrating construction of a central absorption member and an inner and outer absorption chambers of the shock absorption system.

DETAILED DESCRIPTION OF THE INVENTION

Figure 3:
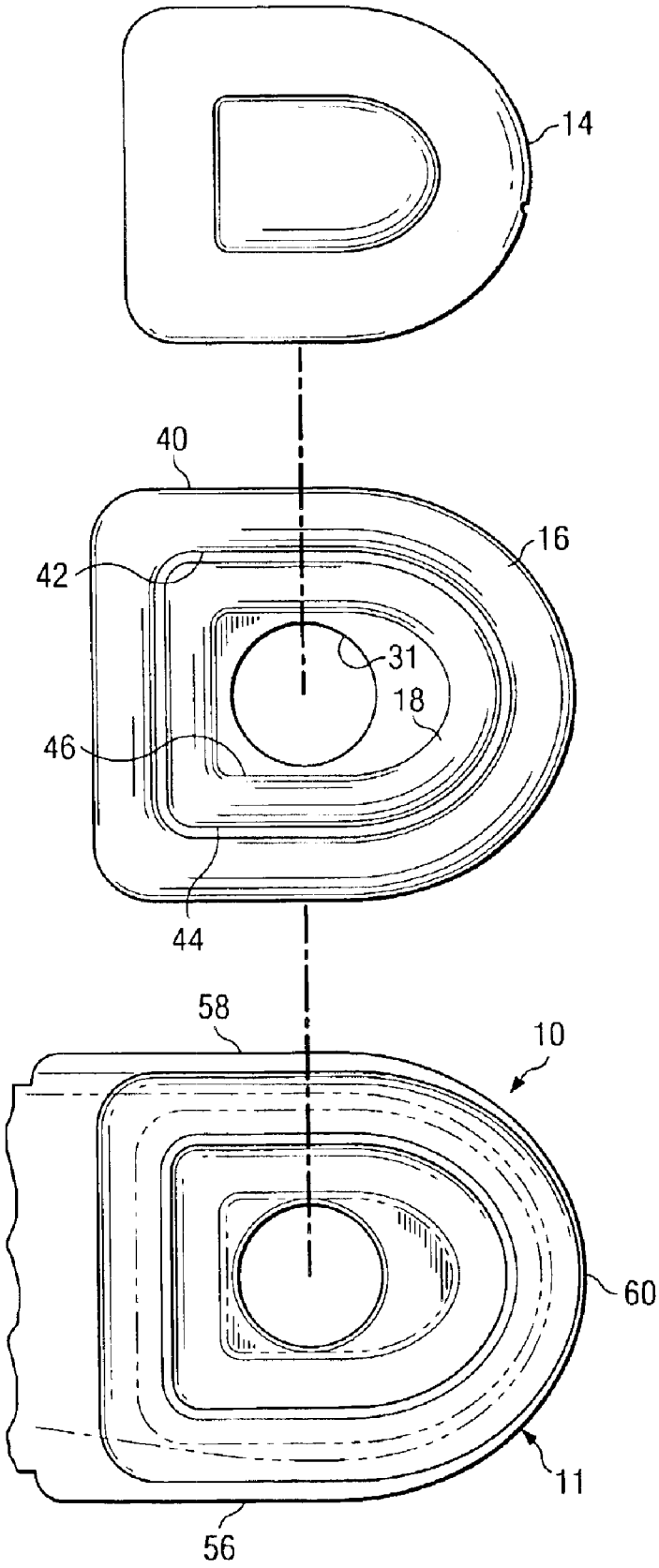
FIG. 3 is a top view, according to one aspect of the present invention, illustrating construction of the central absorption member and inner and outer absorption chambers of the shock absorption system.

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

FIG. 1 illustrates a cutaway cross-section of a heel portion of a footwear 10 illustrating a shock absorption system 12 constructed in accordance with one aspect of the present invention. The shock absorption system 12 includes a central absorption member 14 disposed within a heel portion of a sole 11 of the footwear 10. The central absorption member 14 is illustrated as extending from the upper portion of the sole 11 to the lower portion or bottom surface of the sole 11. The central absorption member 14 promotes reducing the shock or impact from a hard landing or impact with a hard surface by the footwear 10.

The central absorption member 14 may be constructed from a variety of resilient or shock resistant or shock absorbing materials such as polymeric materials, urethane, solid urethane, whether low density urethane or otherwise, PORON or SORBATHANE or other shock or impact resistant materials sufficient for these purposes and will readily suggest themselves to one of ordinary skill in the art.

According to one aspect, such dense shock absorbing material is useful for reducing the shock to the wearer's ankles and knees, for example, from high impact activities such as jumps or hard landings. The central placement and disposition of the central absorption member 14 is useful since the heel impact area indicated by an arrow 15 provides for maximum absorption of impacts and shock when the heel of the individual impacts this area.

Furthermore, by providing the central absorption member 14 extending from the upper to the lower portion of the sole 11 maximizes the amount of shock absorbing material that may be placed in this area to further increase the shock absorbing capabilities of the present invention. The central absorption member 14 can be seen as extending over a wide area of the heel portion of the sole 11 to further optimize the shock absorbing capabilities of the present invention.

The central absorption member 14 is provided with a first chamber receiving portion 20 and a second chamber receiving portion 22. The first chamber receiving portion 20 is operable to receive an outer absorption chamber 16 defining a passageway 17 operative to retain fluid. The outer absorption chamber 16 has an upper side 24, a lower side 26, and is disposed in the heel portion of the sole 11. The second chamber receiving portion 22 is adapted to receive an inner absorption chamber 18 defining a passageway 19 operative to retain a fluid. The inner absorption chamber 18 has an upper side 28 and a lower side 30 and is disposed within the heel portion of the sole 11.

The outer and inner absorption chambers 16 and 18 are adapted to receive pressurized gases, such as air under pressure and are useful for cushioning the heel portion of the sole 11 while an individual walks or runs, for example. In one aspect, the outer and inner absorption chambers 16 and 18 are filled with a desired volume of pressurized gases so as to be more easily compressed and rapidly resilient which promotes a smoother cushioning surface for mild to moderate impacts, such as walking, light running or landings. Furthermore, the outer and inner absorption chambers 16 and 18 work in combination with the central absorption member 14 to further add to the shock absorption capabilities of the present invention.

The outer and inner absorption chambers 16 and 18 may also be, in one aspect, pressurized bags or molded tubular shaped chambers constructed from substantially polymeric or other plastic material capable of retaining any fluid, gas or liquid, whether or not under pressure. In one aspect, the outer and inner absorption chambers 16 and 18 may be coupled to one another in a side-by-side manner which may be useful for construction and assembly.

FIG. 2 is a side view and FIG. 3 is a top view of the present invention, both illustrating the construction and orientation of the components of the shock absorption system 12 provided in the sole 11 of the footwear 10 according to one aspect of the present invention. FIGS. 2 and 3 illustrate that the central absorption member 14 is positioned through an opening 31 defined by the general U-shape configuration of the inner and outer absorption chambers 16 and 18. In this manner, the central absorption member 14 may extend to a bottom surface 32 of the sole 11 of the footwear 10. It will be appreciated that in some aspects the central absorption member 14 may be covered with a clear or other material such that a portion of the central absorption member 14 is visible, but does not actually extend to the lowest point of the bottom surface 32 of the sole 11.

In the present aspect, however, the central absorption member 14 extends to a point 34 slightly above the bottom surface 32 of the sole 11. A gap 36 or recess defined by the bottom surface 32 of the sole 11 creates an air pocket such that when wearing the footwear 10 suction is created by the air in the gap 36 to promote a sticky characteristic, which is beneficial when engaging in certain athletic activities such as skateboarding, for example. This configuration of the shock absorption system 12 promotes a sticky characteristic that has the effect of sticking or grabbing surfaces that the footwear 10 comes into contact with by the suction-cup-like characteristic caused by the gap 36 of the present invention.

Referring to both FIGS. 2 and 3, another aspect of the inner and outer absorption chambers 16 and 18 are illustrated. The inner and outer absorption chambers 16 and 18 are constructed as a substantially unitary pad or a member wherein the outer absorption chamber 16 is provided with an outer peripheral side 40 and an inner peripheral side 42 and is substantially a D-shaped or heel-shaped chambered fluid tube. In this aspect, the inner absorption member 18 is provided with an outer peripheral side 44 and an inner peripheral side 46 and is a substantially D-shaped or heel-shaped chambered fluid tube.

In this aspect, the inner and outer absorption chambers 16 and 18 are coupled such that the inner peripheral side 42 of the outer absorption chamber 16 is adjacent the outer peripheral side 44 of the inner absorption chamber 18. It will be appreciated that the inner and outer absorption chambers 16 and 18, when configured in this manner, may be constructed as a substantially unitary member for added strength and to simplify handling.

In the present aspect, the opening 31 can be seen adjacent the inner peripheral edge 46 of the inner absorption chamber 18 and extending from a upper side 50 to a lower side 52 of the inner and outer absorption chambers 16 and 18.

It will be appreciated that the inner and outer absorption chambers 16 and 18 may also be configured as a single absorption chamber or as a plurality of absorption chambers which are within the spirit and scope of the present invention. Similarly, various other configurations, dimensions and shapes of the inner and outer absorption chambers 16 and 18 are within the scope of the present invention.

In the present aspect, a portion 54 of the outer absorption chamber 16 may be visible by an individual along an outer edge of the side of the sole 11 of the footwear 10. In the present aspect, the portion 54 of the outer absorption chamber 16 can be seen extending on a first side 56 of the sole 11, about a back portion 60 and on a second side 58 of the sole 11. One advantage of this construction and configuration is that the portion 54 of the outer absorption chamber 16 acts as a shock-absorber for cushioning impacts between an upper 62 part of the sole 11 and a lower 64 part of the sole 11.

A further advantage of the present invention is that by providing the opening 31 extending through the outer and inner absorption chambers 16 and 18, the inner and outer absorption chambers 18 and 16 provide a more springy and resilient shock absorbing function. Another advantage of this configuration is that it allows for placement of the maximum amount or volume of shock absorbing material of the central absorption member 14 located underneath a heel area 68 of the sole of the footwear for reducing the shock to the wearer's ankles and knees, for example, from any impacts.

It will be appreciated that while the central absorption member 14 is illustrated as a substantially heel-shaped member extending substantially about the upper sides 50 of the outer and inner absorption chambers 16 and 18, in other aspects, the central absorption member 14 may be otherwise configured, all of which are within the spirit and scope of the present invention as disclosed and described herein. It can be seen that the combination of the central absorption member 14 and the outer and inner absorption chambers 16 and 18 operate in conjunction to maximize the comfort of the wearer during low impact activities, while providing maximum shock reducing capabilities during high impact activities.

Thus, it is apparent that there has been provided, in accordance with the present invention, a shock absorption system for the sole that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various elements or components may be combined or integrated in another system or certain features may not be implemented.

Also, the components, techniques, systems, sub-systems, layers, compositions and methods described and illustrated in the preferred embodiment as discrete or separate may be combined or integrated with other components, systems, modules, techniques, or methods without departing from the scope of the present invention. Other examples of changes, substitutions, and alterations are readily ascertainable by one skilled in the art and could be made without departing from the spirit and scope of the present invention.

What is claimed is:

1. A footwear having a shock absorption system, the footwear comprising:

a sole provided with a heel portion, an arch portion and a forefoot portion;

an outer absorption member positioned in the heel portion of the sole of the footwear, the outer absorption member having an upper side, a lower side and an outer surface defining a chamber retaining a fluid, the outer surface of the outer absorption member having an inner peripheral side and an outer peripheral side;

an inner absorption member having an upper side, a lower side and an outer surface defining a chamber retaining a fluid, the outer surface of the inner absorption member having an outer peripheral side, an inner peripheral side defining an opening adjacent the inner peripheral side such that the opening extends from the upper to the lower side of the inner absorption member, and wherein the outer peripheral side of the inner absorption member is coupled adjacent the inner peripheral side of the outer absorption member; and an central absorption member constructed of a shock absorbing material having an upper portion extending substantially about the upper sides of the inner and outer absorption members, the central absorption member having a central portion extending from an upper side of the heel portion of the sole to a lower side of the heel portion of the sole through the opening adjacent the inner peripheral side of the inner absorption member.

2. The footwear of claim 1, wherein the heel portion of the sole of the footwear is further defined as having a back, a first side and a second side and wherein the fluid member is located in the heel portion of the sole such that the fluid member visibly forms a portion of the first and second sides of the heel portion of the sole of the footwear.

3. The footwear of claim 2, wherein the fluid member is further located in the heel portion of the sole such that the fluid member visibly forms a portion of the back of the heel portion of the sole of the footwear.

4. The footwear of claim 1, wherein a portion of the inner and outer absorption members are shaped substantially similar to a shape of the heel portion of the sole of the footwear.

5. The footwear of claim 1, wherein the inner and outer absorption members are defined as substantially D-shaped members.

6. The footwear of claim 1, wherein the sole is further provided with a bottom surface and wherein the central portion of the central absorption member extend to a point adjacent the bottom surface of the sole of the footwear.

7. The footwear of claim 1, wherein the sole is further provided with a bottom surface and wherein the central portion of the central absorption member extend to a point above the bottom surface of the sole of the footwear.

8. The footwear of claim 1, wherein the chamber of the inner and outer absorption members retain a pressurized gas.

9. The footwear of claim 1, wherein the upper portion of the central absorption member extends over a portion of the upper side of the outer surface of the outer absorption member and over the upper side of the outer surface of the inner absorption chamber such that the central absorption member and inner and outer absorption members operate in conjunction to reduce the shock from impacts of the heel portion of the sole of the footwear.

10. The footwear of claim 9, wherein a first portion of the upper portion of the central absorption member is configured to receive the portion of the upper side of the outer surface of the outer absorption member and wherein a second portion of the upper portion of the central absorption member is configured to receive the upper side of the outer surface of the inner absorption chamber such that the central absorption member and inner and outer absorption members operate in conjunction to reduce the shock from impacts of the heel portion of the sole of the footwear.

* * * * *